US007515065B1

(12) United States Patent
Bygrave et al.

(10) Patent No.: US 7,515,065 B1
(45) Date of Patent: Apr. 7, 2009

(54) EARLY WARNING SYSTEM FOR APPROACHING EMERGENCY VEHICLES

(75) Inventors: Chris Bygrave, Eastleigh (GB); Oliver Dineen, Winchester (GB); Phillip Norton, Eastleigh (GB); David R. Bell, Southampton (GB)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/104,668

(22) Filed: Apr. 17, 2008

(51) Int. Cl.
*G08G 1/00* (2006.01)

(52) U.S. Cl. ..... 340/902; 340/905; 340/901; 340/904

(58) Field of Classification Search ..... 340/901, 340/902, 904, 905
See application file for complete search history.

(56) References Cited

U.S. PATENT DOCUMENTS

| | | | | |
|---|---|---|---|---|
| 5,825,304 | A | 10/1998 | Marin | |
| 6,529,831 | B1 | 3/2003 | Smith et al. | |
| 6,535,116 | B1 | 3/2003 | Zhou | |
| 6,700,504 | B1 * | 3/2004 | Aslandogan et al. | 340/901 |
| 6,940,422 | B1 | 9/2005 | Bachelder et al. | |
| 6,958,707 | B1 | 10/2005 | Siegel | |
| 7,098,806 | B2 | 8/2006 | Bachelder | |
| 7,099,776 | B2 | 8/2006 | King et al. | |
| 7,113,107 | B2 | 9/2006 | Taylor | |
| 7,271,736 | B2 * | 9/2007 | Siegel et al. | 340/902 |
| 2002/0008635 | A1 * | 1/2002 | Ewing et al. | 340/902 |
| 2002/0102961 | A1 | 8/2002 | Gibbons et al. | |
| 2003/0141990 | A1 | 7/2003 | Coon | |
| 2004/0155795 | A1 | 8/2004 | Quintana | |
| 2006/0061484 | A1 | 3/2006 | Gutting et al. | |
| 2007/0159354 | A1 * | 7/2007 | Rosenberg | 340/902 |
| 2007/0216539 | A1 * | 9/2007 | D'Antoni et al. | 340/902 |

* cited by examiner

*Primary Examiner*—Brent Swarthout
(74) *Attorney, Agent, or Firm*—Suiter Swantz pc llo

(57) ABSTRACT

The present disclosure is a method for alerting road users to the presence of an emergency vehicle. The method for alerting road user to the presence of an emergency vehicle may include receiving a short range signal, the signal including information regarding an emergency vehicle, decoding the signal, notifying a user, and transmitting the information regarding an emergency vehicle via a short range wireless signal. Each vehicle may include a short range wireless signal transceiver which could create a daisy chain distribution mechanism to distribute the information regarding an emergency vehicle to a first vehicle than to a second vehicle quickly and efficiently.

1 Claim, 2 Drawing Sheets

EARLY WARNING SYSTEM FOR APPROACHING EMERGENCY VEHICLES

TECHNICAL FIELD

The present disclosure generally relates to the field of warning systems, and more particularly to a method to provide early warning for approaching emergency vehicles.

BACKGROUND

Emergency vehicles currently use loud sirens and flashing lights for alerting other road users to the presence of approaching emergency vehicles. However, audio alerts are often unreliable. Vehicles are often noisy environments created by conversation, radios and CD players which prevent the driver from being aware of an audio alert from an approaching emergency vehicle.

Visual alerts are also be unreliable as they rely on driver awareness (which is often reduced in situations such as traffic jams when cooperation between emergency vehicles and other road users is essential). Visual and audio alerts have a very limited range of effectiveness due to the limited range of awareness associated with visual and audio alerts. Traffic congestion also inevitably builds up near to the destination of the emergency vehicle (such as an accident, fire, etc.), causing further delays to the emergency vehicle and limiting the effectiveness of the services associated with the emergency vehicle.

SUMMARY

The present disclosure is directed to a method for alerting road users to the presence of an emergency vehicle. In an embodiment of the invention, method for alerting road users may include receiving a short range signal, the signal including information regarding an emergency vehicle, decoding the signal, notifying a user, and transmitting the information regarding an emergency vehicle via a short range wireless signal. Advantageously, each vehicle may include a short range wireless signal transceiver which could create a daisy chain distribution mechanism to distribute the information regarding an emergency vehicle quickly and efficiently.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Figure 1:
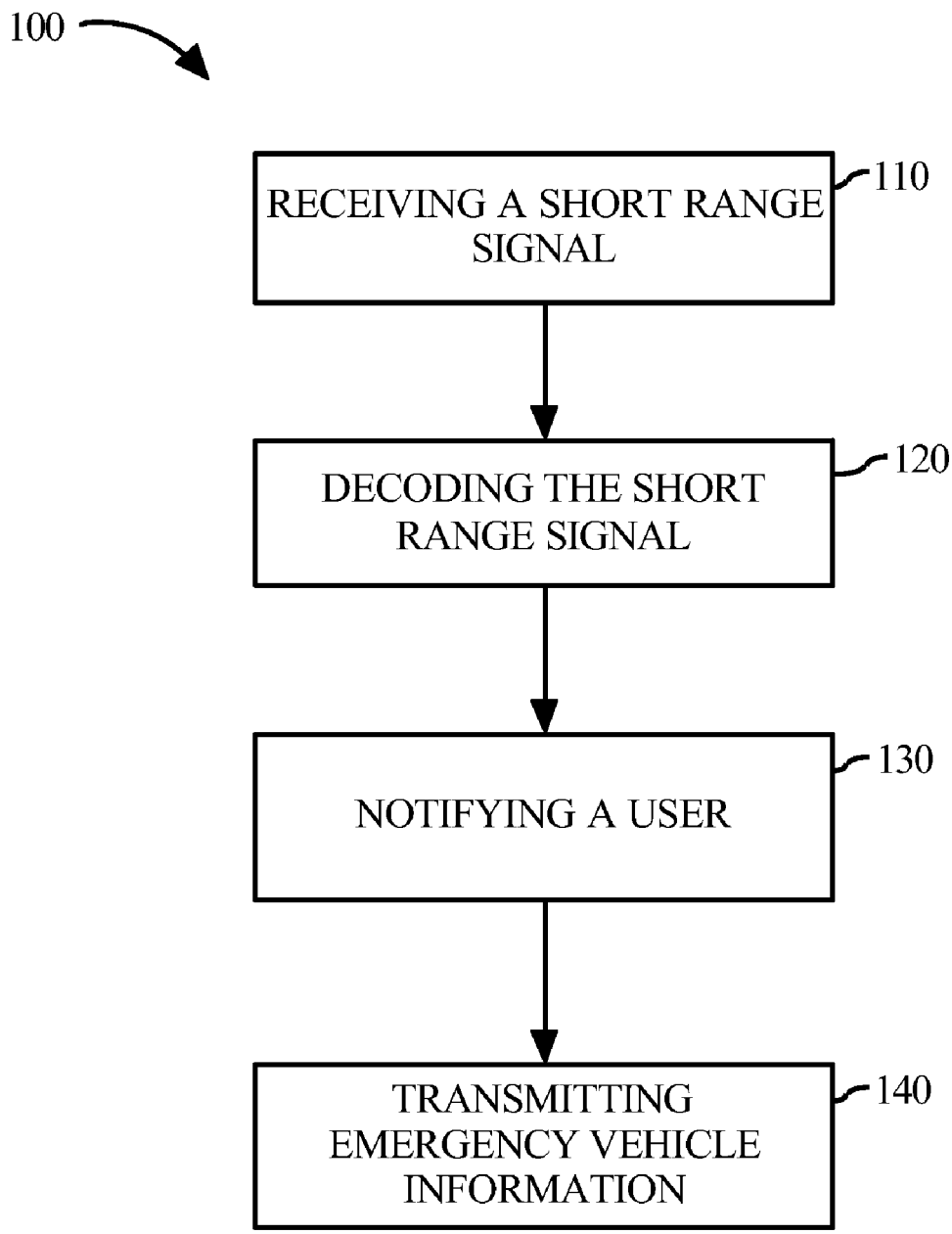
FIG. 1 is a flow diagram representing a method for providing an early warning for approaching emergency vehicles.

Referring to FIG. 1, a flow diagram representing a method 100 for providing an early warning for approaching emergency vehicles is shown. Emergency vehicles may include police cars, ambulances, fire trucks government agents and the like. Method 100 may be executed to distribute presence information over wireless technology to cover a wider range than may be achieved with conventional audio and visual alerts associated with emergency vehicles.

Method 100 for providing an early warning for approaching emergency vehicles may include receiving a short range signal 110. The short range signal may include information regarding an emergency vehicle. Short range wireless signal may refer to a signal transferable across a range of about a few centimeters to about two kilometers. At distances greater than about two kilometers, short range signal may not be received. Short range signals are typically located in an ultra high frequency band (300 MHz to 3 GHz). Short range signals may include those signals in accordance with WiFi, Bluetooth, Zigbee, IEEE 802.11 and the like.

Method 100 may include decoding the short range signal 120. Decoding may include detecting a time stamp of the short range signal and determining appropriate action for a user. Appropriate action may include a lane change, road change, and speed change. Decoding the short range signal may include transforming the data into a form suitable for delivery to a user. Information regarding an approaching emergency vehicle may include location, destination, and route information (hereafter referred to as "presence information") of the emergency vehicle.

Next, method 100 may include notifying a user regarding the approaching emergency vehicle 120. For example, an alert may be displayed in the vehicle to notify and alert the user. Advantageously, a user may be prepared for pre-emptive actions to be taken on the route in order to ease the passage of the emergency vehicle to and from the scene of the accident.

Method 100 may further include transmitting the information regarding an emergency vehicle via a short range wireless signal. Advantageously, each vehicle may include a short range wireless signal transceiver which could employ a daisy chain to distribute the information regarding an emergency vehicle quickly and efficiently.

Figure 2:
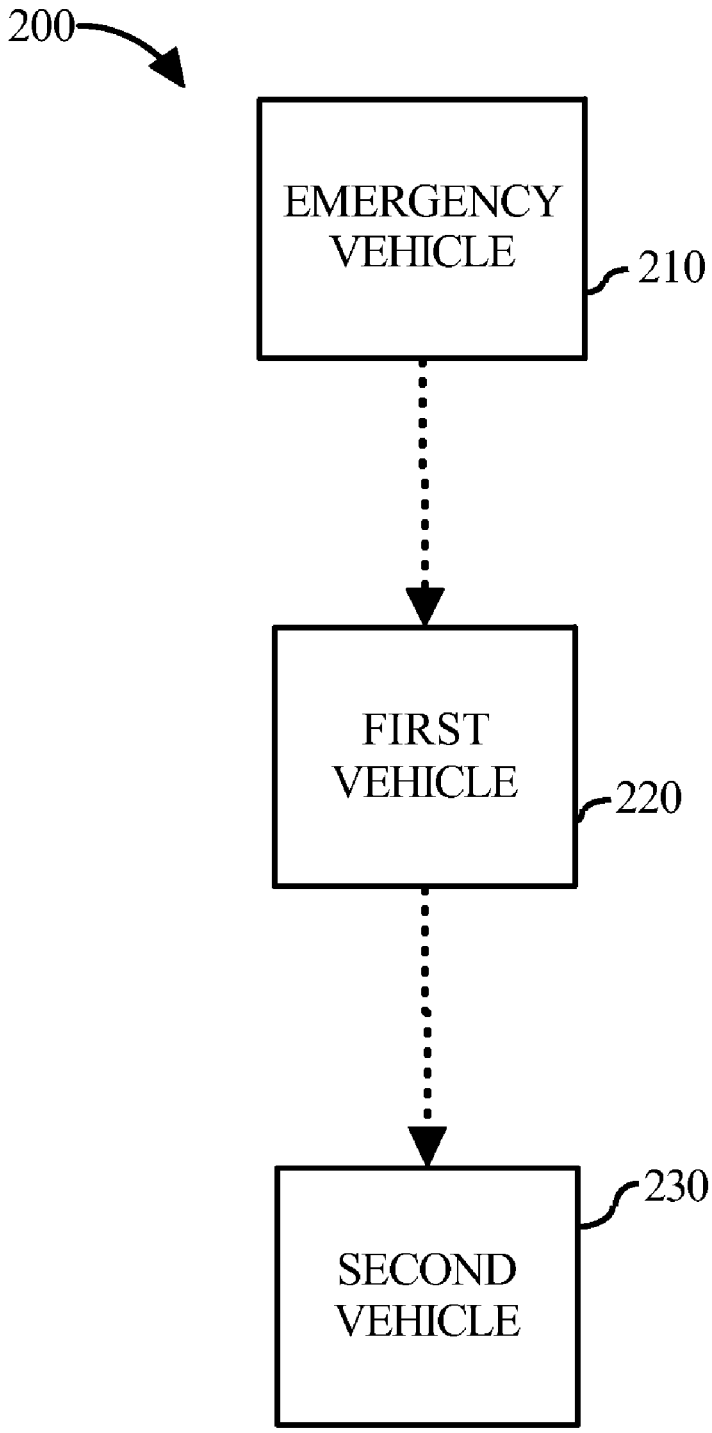
FIG. 2 depicts a daisy chain distribution mechanism.

Referring to FIG. 2, an exemplary daisy chain distribution mechanism 200 is shown whereby an emergency vehicle 210 may alert a first vehicle 220 which may also transfer information to a third vehicle 230. Vehicles within range can contain devices designed to receive and decode this information. Software within the device can then determine if the emergency vehicle will pass near to this vehicle. If this is the case, an alert could be fired (for example, audio within the car could be stopped and a visual or audio alert played to the occupants) to alert the driver of the vehicle of the need to make a clear path for the oncoming emergency vehicle. If the car was navigating using satellite navigation, the route could automatically update to a different route avoiding the area of the accident or crossover with the route of the emergency vehicle. In addition to this, the vehicle then retransmits the received data, thus increasing the range of the signal and alerting further vehicles not yet in range of the original signal from the emergency vehicle.

It is contemplated that global positioning system (GPS) technology may be employed with method 100 to track and transfer precise presence and movement information. For example, each short range transceiver, (receiver and transmitter) may be associated with a GPS receiver and further including an associated display to provide current location information and the ability to receive presence information of emergency vehicles.

It is contemplated that presence information from an emergency vehicle may include specific lane information whereby other vehicles may be removed from a lane of travel of the emergency vehicle to enhance travel for the emergency vehicle.

EXAMPLE

An example of a method for providing early warning for approaching emergency vehicles is described. An emergency is reported and the regional ambulance control center dispatches an ambulance which is equipped with a GPS-enabled device to provide routing information, and programs in the destination to this device. The device then continuously transmits live presence information while en route to and from the accident location. A row of vehicles is currently stuck in traffic caused by the accident ahead. A vehicle near the end of the queue is in range of the short range signal and receives it on a similar GPS-enabled device. This vehicle now has details of the ambulance's current location, destination, route, and time of transmission. Routing software within the device analyzes this information and compares it with the vehicle's current location. The software determines that the emergency vehicle will need to pass through the section of road currently occupied by the vehicle, and an alert occurs to the occupants via a screen on the device, and through the audio system of the car. The driver of the vehicle begins to make way for the oncoming vehicle. The signal is retransmitted, enabling traffic further on in the queue to respond in a similar fashion. Upon arrival, the emergency vehicle should find making progress towards the accident location much quicker and easier, thereby improving response times and chances of survival of the victims of the accident.

In an alternative embodiment, a method to provide early warning for approaching emergency vehicles may include broadcasting presence information across a relevant region. The broadcasted information may be encoded in radio waves without disrupting normal radio service, in a similar was as radio data system (RDS) signals are used as flags for traffic and news programs. Devices similar to current RDS radios (and with access to GPS positioning hardware and route software) may intercept these signals, decode them and determine whether the current location of the emergency vehicle and its intended route would bring it close to the current location of the vehicle.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A method for providing warning for approaching emergency vehicles, comprising:

receiving a short range signal, the signal including location, destination and route information regarding an emergency vehicle, the short range signal being transferable from a range between about two centimeters and two kilometers;

decoding the short range signal, said decoding including detecting a time stamp of said short range signal and determining appropriate action for a user, said appropriate action including a road change, lane change and speed change;

notifying a user; said notifying said user including displaying information concerning said appropriate action; and transmitting the location, destination and route information regarding an emergency vehicle via a short range wireless signal.

* * * * *